US008182280B1

(12) United States Patent
Terhune, IV

(10) Patent No.: US 8,182,280 B1
(45) Date of Patent: May 22, 2012

(54) SOCKET CONNECTOR HAVING CUSHIONING ARRANGEMENT FACILITATING SMOOTH PLACEMENT AND EJECTION OF ELECTRONIC DEVICE

(75) Inventor: Albert Harvey Terhune, IV, Chandler, AZ (US)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/069,350

(22) Filed: Mar. 22, 2011

(51) Int. Cl.
*H01R 13/64* (2006.01)

(52) U.S. Cl. ..... 439/374

(58) Field of Classification Search ..... 439/374, 439/330–331, 259, 266, 342, 73, 71, 67–69, 439/353–357
See application file for complete search history.

(56) References Cited

U.S. PATENT DOCUMENTS

| | | | | |
|---|---|---|---|---|
| 7,267,554 | B2 | 9/2007 | Huang | |
| 7,316,573 | B2 | 1/2008 | Xie et al. | |
| 7,777,329 | B2 * | 8/2010 | Colbert et al. | 257/719 |
| 7,862,363 | B2 * | 1/2011 | Chen et al. | 439/331 |
| 7,867,004 | B2 * | 1/2011 | Ma | 439/331 |
| 7,938,665 | B2 * | 5/2011 | Fan et al. | 439/326 |
| 2005/0159026 | A1 * | 7/2005 | Ma et al. | 439/66 |
| 2006/0148298 | A1 * | 7/2006 | Nakao et al. | 439/331 |
| 2007/0128917 | A1 * | 6/2007 | Ho | 439/331 |
| 2008/0280476 | A1 * | 11/2008 | Ma | 439/331 |

* cited by examiner

*Primary Examiner* — Jean F Duverne
(74) *Attorney, Agent, or Firm* — Andrew C. Cheng; Wei Te Chung; Ming Chieh Chang

(57) ABSTRACT

A socket connector includes a mating portion with a plurality of contacts received therein, a sidewall extending upwardly form the mating portion; and a movable supporting member mounted with the sidewall. The supporting member has a seating plane that is higher than a plane defined by utmost tips of the contacts when in a free position and does not extend over the contact field in the mating portion from a top view.

12 Claims, 7 Drawing Sheets

SOCKET CONNECTOR HAVING CUSHIONING ARRANGEMENT FACILITATING SMOOTH PLACEMENT AND EJECTION OF ELECTRONIC DEVICE

BACKGROUND OF THE INVENTION

1. Field of the Invention

The present invention relates to a socket connector, and more particularly to a socket connector having a cushioning arrangement facilitating placement and ejection of an electronic device.

2. Description of Related Art

An IC package, such as a CPU (Central Processing Unit), is generally coupled with a system via a socket connector mounted on a mother board. A typical socket connector is disclosed by U.S. Pat. No. 6,877,990 issued to Fang-Jwu, Liao et al., on Apr. 12, 2005. The socket connector includes a socket body with a plurality of contacts received therein. A CPU is placed upon the socket body and electrically connects with the contacts therein such that an electrical connection is established therebetween. The socket body has sidewalls extending upwardly form periphery of the socket body so as to position the CPU. However, when the CPU is manually placed toward the socket body, the risk of the accidental dropping of the CPU into the contact field in the socket body exists and may thus damage the contacts. In addition, it is not convenient for a user to take the out the CPU that sinks in the socket connector.

U.S. Pat. No. 7,267,554 issued to Huang-Chou Huang, on Sep. 11, 2007 discloses an improved socket connector. The socket connector includes a cushion that supported by multitude of springs and located above the array of contacts before a CPU is loaded. The cushion has an array of through holes aligning with the contacts respectively. The CPU is firstly placed upon the cushion and then actuated by a rotatable cover so as to push the cushion toward the contacts. The contacts finally pass through the through holes of the cushion and connect with the CPU so that the electrical connection is established therebetween. The cushion works as a buffer and thus reduces the risk of the CPU accidentally damaging the contacts. However, the cushion that has a complicated structure of high density of through slots brings a high requirement to the precision of the cushion and its moving trajectory. In worse scenario, the cushion may damage the contacts directly.

In view of the above, an improved socket connector is desired to overcome the problems mentioned above.

SUMMARY OF THE INVENTION

Accordingly, an object of the present invention is to provide a socket connector having a cushioning arrangement that facilitates placement and ejection of an electronic device so as to reduce the risk of the damage to the contacts residing in the socket connector.

According to one aspect of the present invention there is provided a socket connector which includes a mating portion with a plurality of contacts received therein, a sidewall extending upwardly form the mating portion; and a movable supporting member mounted with the sidewall. The supporting member has a seating plane that is higher than a plane defined by utmost tips of the contacts when in a free position and does not extend over the contact field in the mating portion from a top view.

Other objects, advantages and novel features of the invention will become more apparent from the following detailed description when taken in conjunction with the accompanying drawings, in which:

DETAILED DESCRIPTION OF THE INVENTION

Reference will now be made to the drawings to describe the present invention in detail.

Figure 1:
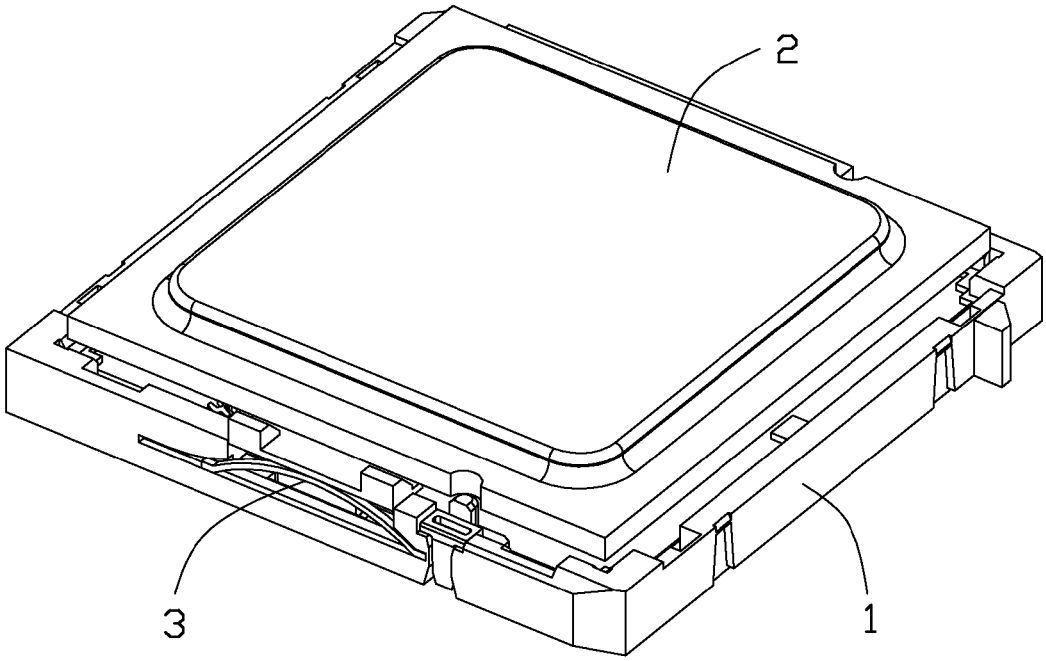
FIG. 1 is an assembled, perspective view of a socket connector and an electronic device in accordance with a preferred embodiment of the present invention.
Figure 2:
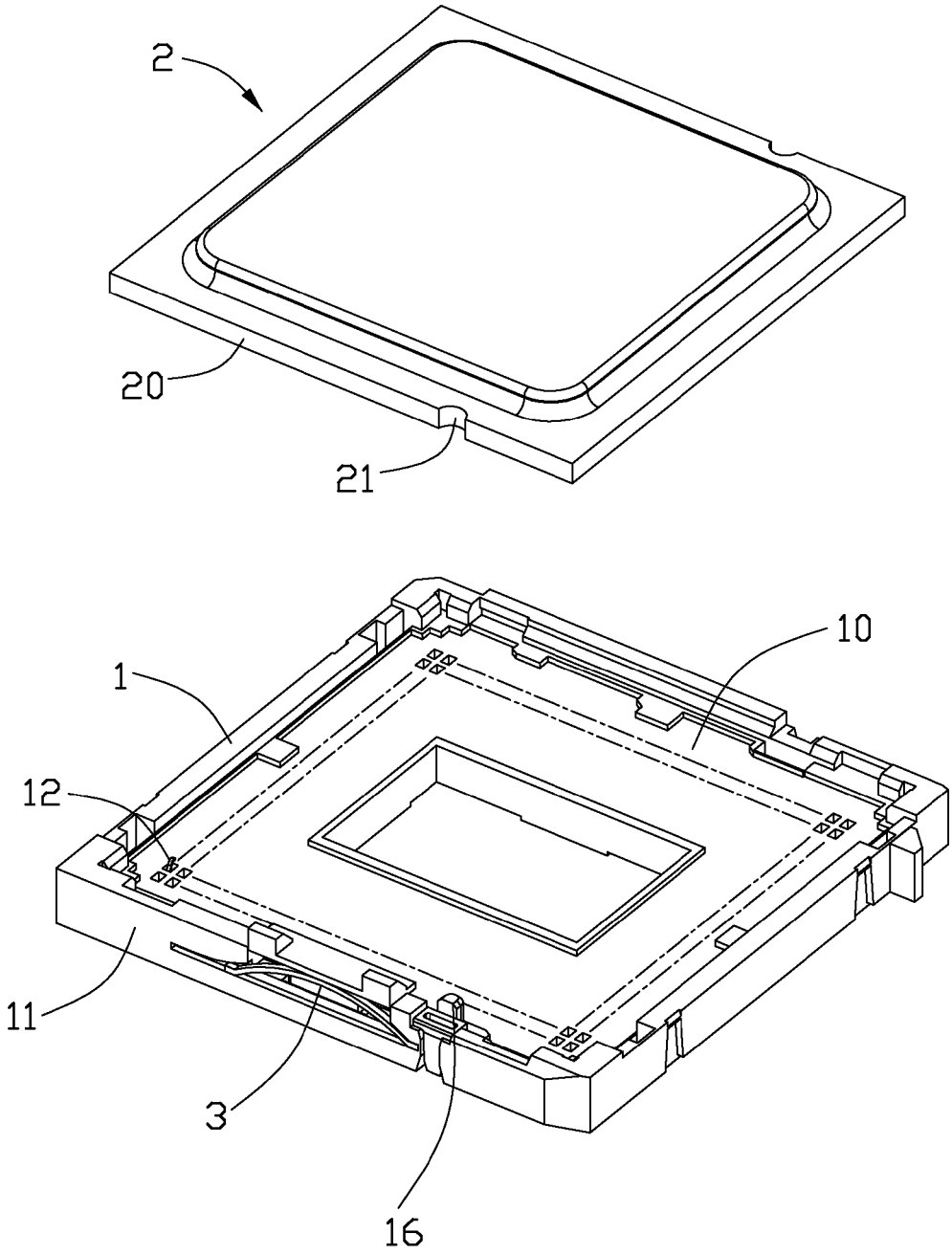
FIG. 2 is an exploded, perspective view of the socket connector and the electronic device as shown in FIG. 1.

Referring to FIG. 1 and FIG. 2, a socket connector 1 made in accordance with the present invention is provided facilitating interconnection between an electronic device 2 and a motherboard (not shown). The socket connector 1 is formed with a plurality of contacts 12 retained therein for electrical connection with the electronic device 2.

Figure 3:
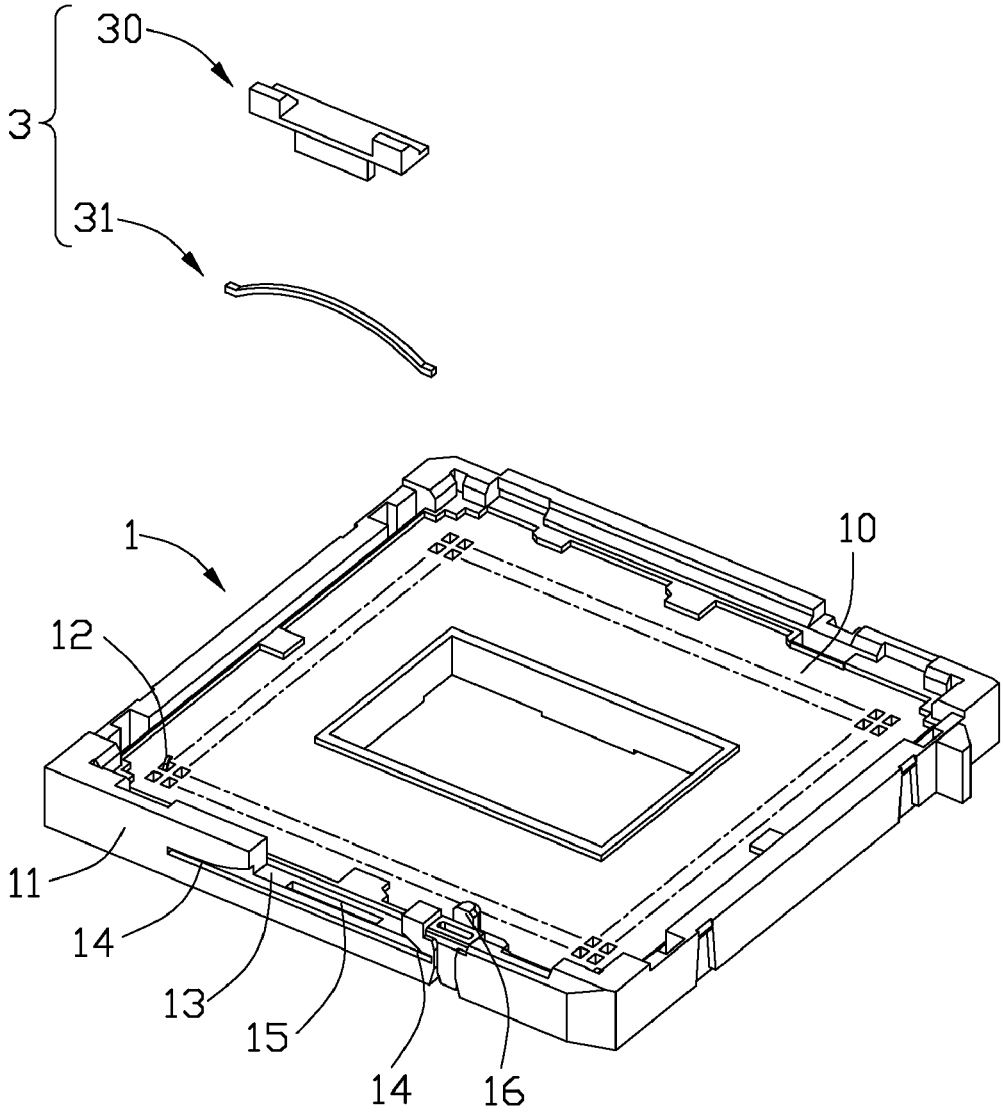
FIG. 3 is an exploded, perspective view of the socket connector in accordance to the preferred embodiment of the present invention.
Figure 4:
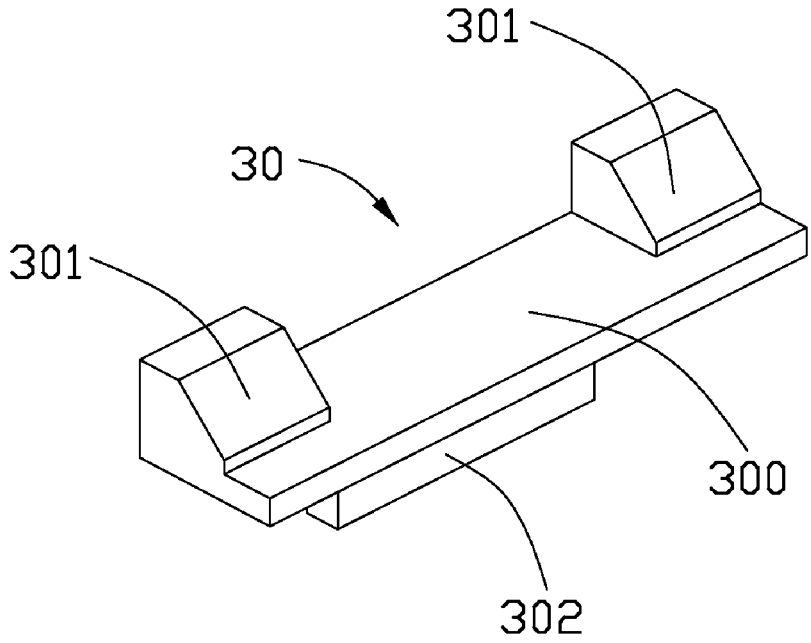
FIG. 4 is a perspective view of a supporting member of the socket connector in accordance to the preferred embodiment of the present invention.
Figure 5:
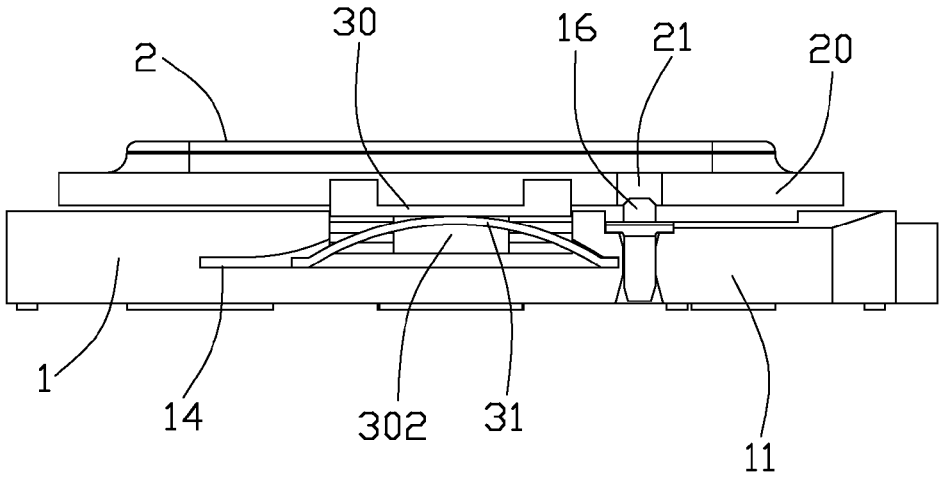
FIG. 5 is a side view of the socket connector with an electronic device received thereon in a free position.
Figure 6:
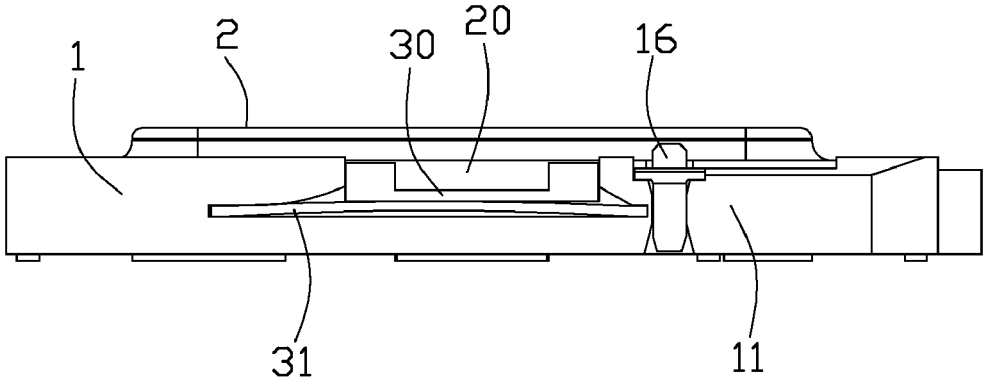
FIG. 6 is a side view of the socket connector with the electronic device received thereon in a depressed position.

Particularly referring to FIG. 2 to FIG. 3, the socket connector 1 includes a rectangular mating portion 10 and sidewalls 11 extending upwardly from periphery of the mating portion 10. The contacts 12 are received in the mating portion 10 in an array manner. A cushioning arrangement 3 is provided within at least one sidewall 11 for facilitating the placement and ejection of the electronic device 2. The sidewall 11 is configured with a cavity 13 formed by recessing downwardly from the sidewall 11. A pair of sliding slots 14 are extended in the sidewall 11 and communicated with the cavity 13. Below the cavity 12 is a guiding slot 15 that extends downwardly into the sidewall 11. In addition, a positioning post 16 is mounted within the sidewall 11 and located near the cavity 13.

Particularly referring to FIG. 3 to FIG. 6, the cushioning arrangement 3 includes a supporting member 30 and a bridge-shaped spring member 31 located under and actuating the supporting member 30. The supporting member 30 is vertically movable in the cavity 13 of the sidewall 11, and in correspondence to the movement of the supporting member 30, the spring member 31 deforms with opposite ends thereof sliding respectively in the sliding slots 14 in the sidewall 11. The supporting member 30 is further formed with a planar seating plane 300, a pair of positioning blocks 301 extending upwardly from the seating plane 300, and a guiding tab 302 extending downwardly from the bottom of the seating plane 300. The positioning blocks 301 serves for restraining the electronic device 2 in a correct position. The guiding tab 302 is inserted into the guiding slot 15 of the socket connector 1 such that the supporting member 30 is reliably restrained in a vertical direction.

When the cushioning arrangement 3 is disposed in a free position before the electronic device 2 is loaded, the seating plane 300 is established at a level higher than a plane defined by the utmost tips of the contacts 2 but lower than a top end of the positioning post 16. When the electronic device 2 is placed on the socket connector 1, the positioning post 16 engages a notch 21 on a substrate 20 of the electronic device 2 in advance to provide a pre-positioning purpose for the electronic device 2. When the electronic device 2 is further depressed downwardly by an external mechanism (not shown), it pushes the cushioning arrangement 3 downward to a depressed position and makes the bridge-shaped spring member 31 deform with opposite ends thereof sliding in the sliding slots 14 of the sidewall 11. The electronic device 2 reliably engages the contacts 12 in the mating portion 10 of the socket connector 1 when the cushioning arrangement 3 is disposed in the depressed position and thereby establishing an electrical connection with the socket connector 1. When the work load from the external mechanism is released, the supporting members 30 moves upwardly to its original position by the restoring force of the spring member 31 and lifts up the electronic device 2 to an upper position where the electronic device 2 could be picked up and taken out of the socket connector 1 easily either by manual operation or a robot.

The seating plane 300 according to the present invention has a smaller real estate and does not extend over the contact field in the mating portion 10 from a top view, such that it will not interfere the engagement between the electronic device 2 and the contacts 12. In addition, no through slots or the like is required to be formed on the supporting member for the contacts 12, and complicated structure and high precision requirement to the supporting member are therefore omitted.

The seating plane 300 in a free position is established at a higher level than a plane defined by utmost tips of the contacts 12. As the electronic device 2 is firstly engaged the cushioning arrangement 3 before comes to touch the contacts 12, the risk of accidentally damaging the contacts is reduced. In addition, the cushioning arrangement 3 elevates the seating plane 300 to a higher level for the electronic decide 2, and therefore make it easy for a user or a robot to place or pick up the electronic device 2.

According to the above-described embodiment of the present invention, a bridge-shaped spring member 31 is preferably selected. Besides, coil springs are also feasible for serving the similar purpose.

Figure 7:
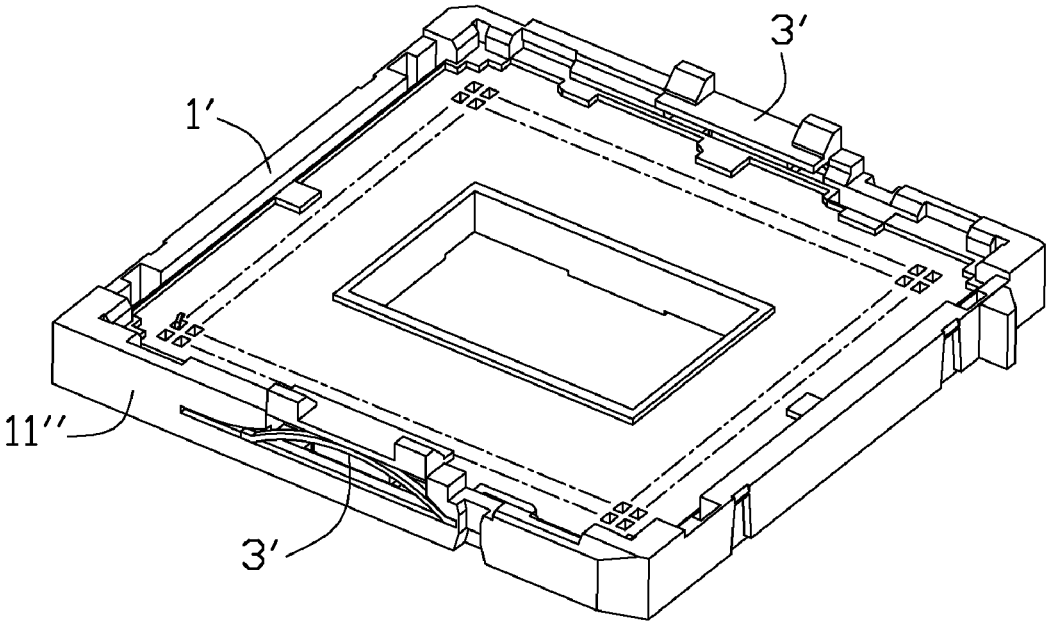
FIG. 7 is an assembled, perspective view of a socket connector in accordance to a modified embodiment of the present invention.

Referring to FIG. 7, a modification is made to the preferred embodiment. The socket connector 1' according to the modified embodiment is provided with a pair of such cushioning arrangements 3' located at opposite sidewalls 11' thereof, which allows a better balance for the electronic device when put onto the socket connector 1'. It is reasonable to conclude that the manner that the cushioning arrangements are provided at four sidewalls of the socket connector is also available, according to the spirit of the present invention.

While preferred embodiments in accordance with the present invention has been shown and described, equivalent modifications and changes known to persons skilled in the art according to the spirit of the present invention are considered within the scope of the present invention as defined in the appended claims.

What is claimed is:

1. A socket connector, comprising:

a mating portion with a plurality of contacts received therein;

a sidewall extending upwardly form the mating portion; and a movable supporting member mounted with the sidewall and having a seating plane, the seating plane in a free position being established at a level higher than a plane defined by utmost tips of the contacts and not extending over the contact field in the mating portion from a top view; wherein the sidewall is formed with a cavity and the floating supporting member moves within the cavity in a vertical direction; a spring member located under and actuating the supporting member; wherein the spring member is configured with a bridge shape and the sidewall is provided with a pair of sliding slots in which the opposite ends of the spring member slide respectively.

2. The socket connector as claimed in claim 1, wherein the supporting member has a positioning portion engaged with a periphery of an electronic device such that the electronic device is reliably positioned by the supporting member.

3. The socket connector as claimed in claim 1, wherein the supporting member has a guiding tab, and the sidewall has a guiding slot engaged with the guiding tab so as to guide the supporting member to move along a vertical direction.

4. The socket connector as claimed in claim 1, wherein the sidewall is further provided with a positioning post engaged with a notch of an electronic device.

5. The socket connector as claimed in claim 4, wherein a top end of the positioning post is higher than the seating plane.

6. The socket connector as claimed in claim 1, wherein the movable supporting members are provided to be located either at a pair of opposite sidewalls or at four sidewalls of the socket connector.

7. A socket connector for an electronic device, comprising:

a mating portion with a plurality of contacts received therein; and a sidewall extending upwardly from the mating portion and configured to receive a cushioning arrangement therewith;

wherein the cushioning arrangement comprises a supporting member and a spring member actuating the supporting member, the supporting member being formed with a positioning portion engaged with periphery of a substrate of the electronic device; wherein the sidewall is formed with a cavity and the floating supporting member moves within the cavity in a vertical direction; wherein the spring member is configured with a bridge shape, and the sidewall is provided with a pair of first slots in which the opposite ends of the spring member slide respectively; wherein the supporting member has a guiding tab, and the sidewall has a guiding slot engaged with the guiding tab so as to guide the supporting member to move along a vertical direction.

8. The socket connector as claimed in claim 7, wherein the sidewall is further provided with a positioning post engaged with a notch of the electronic device.

9. The socket connector as claimed in claim 8, wherein the supporting member has a planar seating plane and a top end of the positioning post is higher than the seating plane.

10. The socket connector as claimed in claim 7, wherein the supporting member does not extend over the contact field in the mating portion from a top view.

11. The socket connector as claimed in claim 7, wherein the cushioning arrangements are provided to be located either at a pair of opposite sidewalls or at four sidewalls of the socket connector.

12. A socket connector for use with an electronic package, comprising:

an insulative housing defining a receiving cavity upwardly exposed to an exterior;

a plurality of contacts disposed in the housing with contacting sections upwardly extending into the receiving cavity; and a cushioning arrangement formed on the housing beside the receiving cavity and including a supporting member moveable between upper and lower positions; wherein the supporting member is adapted to support the electronic package in an upper standby position essentially above the receiving cavity, ready but not to contact the contacting sections when said supporting member is located in the upper position; the supporting member is adapted to support the electronic package in a lower operation position essentially in the receiving cavity to contact the contacting sections when said supporting member is located in the lower position; wherein the cushioning arrangement further includes a biasing device to not only constantly urge the supporting member to move upwardly but also allow the supporting member to move from the upper position to the lower position; wherein the supporting member provides means for not only supporting the electronic package but also guiding the electronic package in alignment with the receiving cavity.

* * * * *